United States Patent [19]

Claunch et al.

[11] 3,974,528

[45] Aug. 17, 1976

[54] SEWAGE SYSTEM WITH REUSABLE FLUSH MEDIUM

[75] Inventors: Robert W. Claunch; Thomas N. Deane; Patrick D. M. Rogan, all of New Orleans; Carl M. Powe; Mark Werner, both of Slidell, all of La.

[73] Assignee: Chrysler Corporation, Highland Park, Mich.

[22] Filed: Aug. 7, 1975

[21] Appl. No.: 602,698

[52] U.S. Cl. ..... 4/10; 4/115; 4/DIG. 11; 4/DIG. 19; 210/152; 210/167

[51] Int. Cl.[2] ..... E03D 3/00; E03D 5/016; E03D 5/01

[58] Field of Search ..... 4/10, 1, 77, 90, 131, 4/118, DIG. 19, DIG. 11, 115, 114; 210/152, 154, 167, 65, 194, 85

[56] References Cited

UNITED STATES PATENTS

| | | | |
|---|---|---|---|
| 3,079,612 | 3/1963 | Corliss | 4/10 |
| 3,318,449 | 5/1967 | Jennings et al. | 4/10 X |
| 3,431,563 | 3/1969 | Rascov | 4/1 |
| 3,673,614 | 7/1972 | Claunch | 4/10 |
| 3,824,632 | 7/1974 | Bach | 4/12 |
| 3,829,909 | 8/1974 | Rod et al. | 4/10 |
| 3,864,258 | 2/1975 | Richardson et al. | 4/10 X |
| 3,934,275 | 1/1976 | Bishton, Jr. | 4/10 |

*Primary Examiner*—Henry K. Artis
*Attorney, Agent, or Firm*—Talburtt & Baldwin

[57] ABSTRACT

A sewage system in which the transport medium or flush medium is a liquid having a specific gravity less than that of water. The flush medium after transporting sewage waste to a tank or the like thereafter separates from the sewage and floats on top of it becoming available for reuse.

20 Claims, 5 Drawing Figures

SEWAGE SYSTEM WITH REUSABLE FLUSH MEDIUM

BACKGROUND OF THE INVENTION

In conventional sewage systems the flush or transport medium is water. Water represents 90 to 98 percent of the total volume of the sewage handled in conventional systems. If a reusable flush medium is used, which may be readily separated from the sewage wastes, a more compact and efficient sewage system results. When the terms "sewage" or "waste" are used herein they are meant to describe any of the typical forms of waste matter generally encountered in sewage handling systems, including human excreta, paper, cigarette butts and the like.

Systems with reusable flush media have been previously proposed wherein the flush media is of a density different from that of the sewage. U.S. Pat. No. 3,673,614, issued July 4, 1972 to Robert W. Claunch and assigned to the same assignee as the subject application, describes such a system which has been successfully developed and is presently in use. The system described in that patent eliminates the use of water as a flush medium for sewage wastes and substitutes a reusable medium. The reusable flush medium is substantially immiscible with water and of a sufficient difference in density from that of water and other sewage wastes to permit physical separation of the sewage from the flush medium. It is also chemically stable under the operating conditions of the sewage facility and in the presence of sewage waste.

In the patented system, the flush medium is supplied to a point of use, such as an ordinary toilet commode or urinal, then flushed with any waste received through a sewer line into a separating tank. In the separating tank, due to its difference in density, the flush medium rises above the waste to float on it and an interface forms therebetween at the point of contact between the medium and the sewage waste.

Liquid flush medium floating on the waste in the separating tank is preferably passed through a suitable filter means and into a fluid circulation system for reuse. The circulation system preferably includes a pressurized storage tank or accumulator equipped with a pressure switch means which automatically activates a pump in the circulation system when the pressure in the accumulator drops below a pre-set minimum.

The waste collects at the bottom of the separating tank until a sufficient quantity has accumulated to activate an automatic transfer means. Waste is then transferred from the separating tank into a waste receiving means, such as a catch tank, holding tank, incinerator, aerobic digestor or the like. After a given quantity of the waste has been transferred the transfer means automatically stops and the accumulation of waste in the lower part of the separating tank starts again.

The transfer means prevents carryover of sewage waste with the flush medium when it is removed from the separating tank for reuse. It also controls the volume of waste allowed to collect in the separating tank. An electrical control system including floats and switches is used in the patented system to activate the transfer means at appropriate times for controlling the volume of waste and flush medium retained in the separating tank.

SUMMARY OF THE INVENTION

It is an object of this invention to preserve the basic principles, operation and advantages of the aforementioned systems and apparatus while improving their structure and operation through simplification.

These and other objects are attained by providing a system designed in such a manner that the interface between the flush medium and the waste in the separating tank is maintained at a substantially constant level without the use of mechanical or electrical controls as were previously required. In a simplified manner, the invention prevents any significant loss of flush medium through carryover with the waste as it leaves the separating tank and also prevents the carryover of any significant amount of waste with the flush medium as the flush medium is removed from the separating tank for reuse.

More specifically, in the system of the invention, sewage waste is transported as before by the flush fluid medium from a toilet or the like to separation tank where the waste separates and settles while the flush fluid rises to the top due to differences in density of the flush fluid and waste. As the volume of waste and flush fluid increase in the separation tank due to toilet usage, the flush fluid rises and passes through a coalescer which removes entrained moisture. The flush fluid then flows over a weir through a bag filter to remove suspended particles and then flows into a reservoir.

Flush fluid is recirculated to a toilet or the like by a pump/accumulator system controlled by a pressure switch as before.

The quality of the flush fluid is maintained as before, preferably by continual circulation through filters which remove fine particles, dissolved contaminants, surface-active agents, color bodies and odor producing contaminants.

As the waste settles in the lower portion of the separation tank, the hydraulic head increases forcing waste into a waste transfer line which leads to a waste receiving tank or the like. Air which is bubbled into the waste transfer line from a blower reduces the relative density of waste in this line causing it to rise and flow into the waste receiving tank where it may be aerated to maintain an aerobic, odor-free condition or otherwise treated.

Additional transfers of waste cause some waste in the waste receiving tank to flow to a final disposal system that may consist of any one of several operation arrangements.

BRIEF DESCRIPTION OF THE DRAWINGS

The same numbers are used in all Figures to indicate equivalent parts of the systems.

DESCRIPTION OF THE PREFERRED EMBODIMENTS

Figure 1:
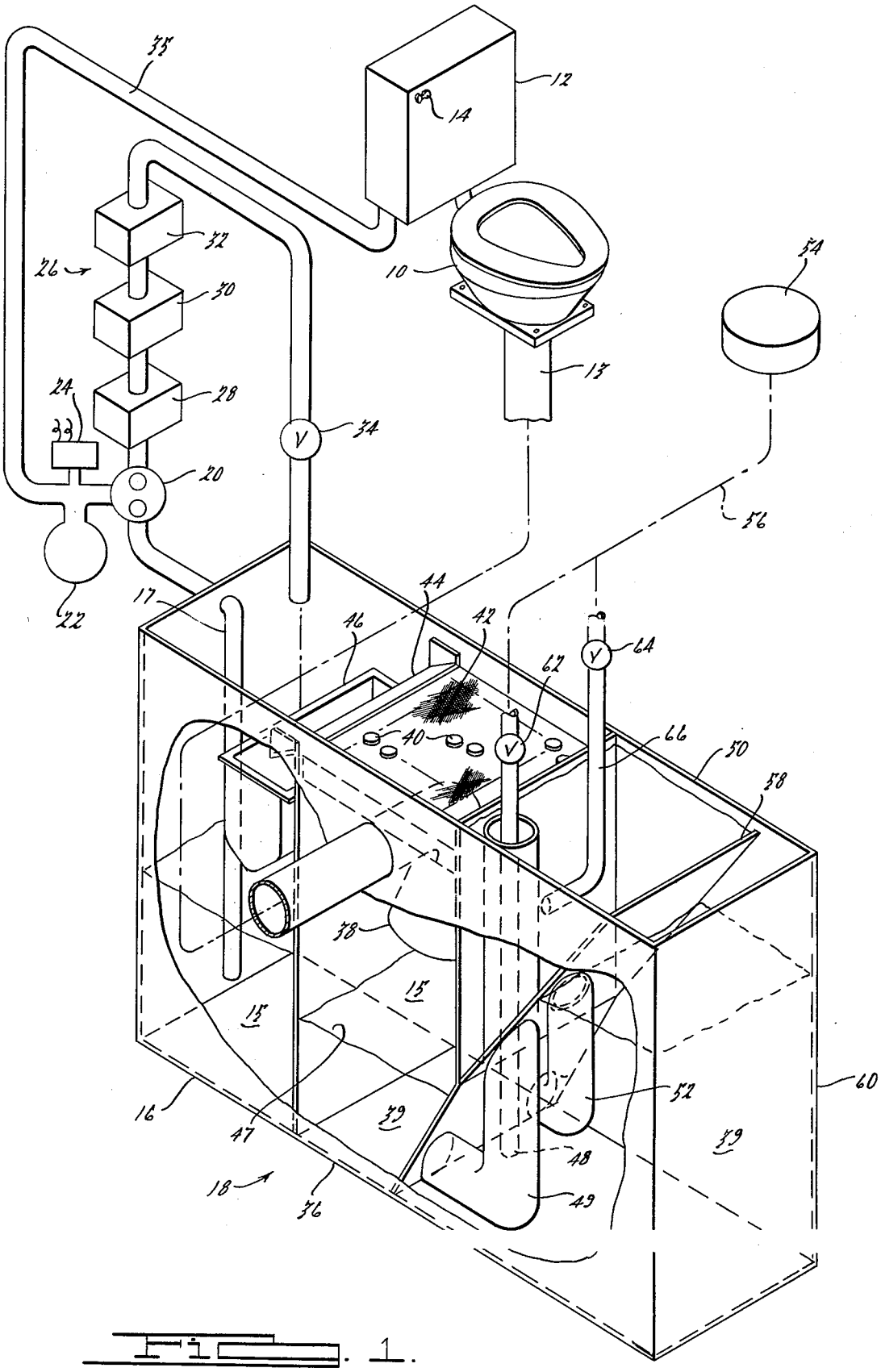
FIG. 1 is a schematic representation of a system according to the invention.

A sewage system and apparatus according to the invention is shown in FIG. 1 connected to a toilet or commode 10 or other waste receiving station. Commode 10 includes a water closet tank 12 for storing a supply of liquid flush medium to be used in flushing the commode. Tank 12 includes a standard valve (not shown) for controlling the flow of the flush medium through commode 10 and into the sewer line of conduit 13 as is well known and practiced in the prior art. The valve is operated by any suitable means, such as the manually operated handle 14. A supply 15 of the liquid flush medium for the system is stored in a flush fluid receiving means or reservoir tank 16 which may take the form of one section of a compartmentalized tank generally indicated by 18. The flush fluid medium is transferred by a pump 20 through conduit 17 to an accumulator 22.

A flow of flush medium, continuous or periodic, is preferably maintained through a fluid maintenance system, generally designated at 26, which includes a particulate filter 28, a carbon filter 30 and a clay filter 32, all of which are well known and need not be described here in detail. The flush medium flows from reservoir 16 through conduit 17, through fluid maintenance system 26, through a flow regulation valve 34, and back into reservoir 16. It may be routed into a separation tank 36, as a design option. The flow rate through fluid maintenance system 26 is preferably maintained at a rate which will allow the total volume of fluid in reservoir 16 to be cleaned over 4 to 8 hours as a function of system usage.

In the case where continuous circulation of the flush medium through maintenance system 26 is desired, an electrically operated by-pass valve (not shown) may be installed between pump 20 and accumulator 22 such that the pump may circulate fluid through the maintenance system on a continuous basis but supply fluid to the accumulator only upon demand.

Various additional means for filtering the flush medium may also be included in separation tank 36. A coalescer filter 42 may be used in combination with other screens to provide substantial filtering of the flush medium. For example, screens of 40 mesh and 20 mesh may be placed to either side of the coalescer. A coalescer is a device or material which tends to accumulate trace quantities of water from the flush medium until large water droplets form which finally drop to fall through the flush medium to the bottom of the separation tank. A fiberglass insulation pad may be used for this purpose. It has the added advantage in that it tends to collect particulate matter and therefore acts as a filter also. Filters of various types may also be included at various other points in the system if desired.

Flush fluid medium stored in accumulator 22 under pressure is used to fill flush tank 12 via conduit 35 following a flush or to supply a flush valve for a commode, urinal or the like (not shown) which may be a user option. Flush fluid enters commode 10 to function as the transport medium for the sewage waste received in the commode. The flush fluid transports the waste via conduit 13 to separating tank 36, preferably through a dispersion cone 38.

Separating tank 36 may take the form of a section of compartmentalized tank structure 18 as shown. Separation of the sewage waste and the flush fluid medium takes place in separation tank 36 and flush fluid 15 due to its flotation on the waste 39 in tank 36 passes upwardly as it increases in volume, preferably through a layer of chlorine tablets 40, coalescer 42, over a weir 44, through a bag filter 46 and into a reservoir tank 16.

The preferred fluids for flush media contemplated for use with this invention are of themselves incapable of providing support for bacteria or viruses. However, a certain level of entrainment at the interface of the fluid medium and the waste in the separating tank is inevitable. Consequently, the incorporation of an oil soluble biocide is desirable to act as a "scavenger" for entrained contamination. Several such biocides have been evaluated and found satisfactory for this purpose. Biobor J. F. which is manufactured by the U.S. Borax Company is a typical example as are solid trichloroisocyanuric and chlorine compounds such as those used in swimming pool chlorinators.

Such an arrangement provides a separating tank for receiving waste being transported by the flush fluid medium, the flush fluid medium 15 separating from the waste 39 upon entering the separating tank and floating on the waste due to its different specific gravity whereby an upper flush fluid medium containing section and a lower waste containing section are established in separating tank 36 with an intermediate interface 47 therebetween.

There is also provided a flush medium outlet means as at weir 44, positioned in the upper section of separating tank 36 for allowing flush medium 15 to flow from separating tank 36 when it is full or at any desired level thereby controlling the volume of the flush medium retained in separating tank 36.

The arrangement also provides a flush fluid medium receiving means, as at tank 16, for receiving the flush fluid medium from separating tank 36 and holding it for reuse.

In the system of FIG. 1, as previously stated, the waste 39 settles to the bottom part of separation tank 36. From there it is transferred, preferably in a continuous recirculation pattern, by a pump means, preferably air lift pump means formed by air line 48 in conduit 49 to introduce air into the bottom of the conduit, through a conduit means or line 49, having an inlet preferably in a lower portion of separating tank 36 as shown, to a waste settling tank 50; line 49 having an outlet means preferably in an upper portion of tank 50 as shown. If it is recirculated, as is preferred, it is returned to the lower portion of separating tank 36 through a second conduit means or line 52. Line 52 has an inlet means in tank 50, preferably at a lower level than the outlet of line 49 and an outlet means in a lower portion of separating tank 36, as shown. The flow in these lines is provided by a pump, preferably an air lift pump means formed by air line 48 and line 49. The air lift pump receives an air supply from a blower 54 via a line 56 and a valve 62. As the waste is transferred around this recirculating loop it is mixed, macerated, oxygenated and aerobically digested by the air stream introduced through air line 48 in conduit 49. The waste tends to form into a partially digested sludge. The waste overflows from tank 50 at weir outlet means 58 when tank 50 is full or at any desired level thereby controlling the volume of waste retained in separating tank 36 and waste settling tank 50.

When the tank 50 is full, as waste is added to separating tank 36, waste spills over at weir 58 into a holding tank 60. Tank 60 may take the form of a section of compartmentalized tank 18 as shown. Tank 60 may or may not be aerated as a function of the requirements for either storage for later pumpout or its use as a digestor evaporator. It may simply be a holding tank or it may provide for any desired additional treatment of the sewage.

Valves 62 and 64 are used to regulate the supply of air to air line 48 and to waste settling tank aerator 66.

The arrangement described above for tank 36, tank 50 and tank 60 provides a first waste receiving tank, as waste settling tank 50, connected to a lower waste containing section of separating tank 36 for allowing waste to flow therefrom into the first waste receiving tank. There is also provided an outlet means as at 58 in the first waste receiving tank for allowing waste to flow from the first waste receiving tank when a certain amount has been collected thereby providing control over the volume of waste retained in separating tank 36 and waste settling or receiving tank 50.

Since the volumes of flush fluid medium and waste in tanks 36 and 50 are held substantially constant, due to the overflow provision at 44 and 58, even with the continuous input of additional sewage wastes transported by the recirculating flush fluid, the selective placement of the two outlet means 44 and 58 along with the designed volume of separating tank 36 and waste settling tank 50 controls the level of interface 47 in separating tank 36 causing it to remain at a substantially constant level or height.

The system according to this invention differs from the aforementioned patented system in that there is no interface level indicator or control mechanism, mechanical or electrical, required because the constant interface level is maintained due to the selected and controlled overflow of flush fluid from separating tank 36 and of sewage from waste settling tank 50.

Any disposal means for the waste following separation may be used at the user's option. In the preferred system of the invention, holding tank 60 receives the sewage which is constantly aerated to cause aerobic digestion. In another version the waste is simply held for pumpout and later disposal. It may be passed to an incinerator if desired. Sufficient air may be provided in the digestor air supply, as at 66, such that with a properly sized air supply and heat input, waste water is also evaporated.

Figure 2:
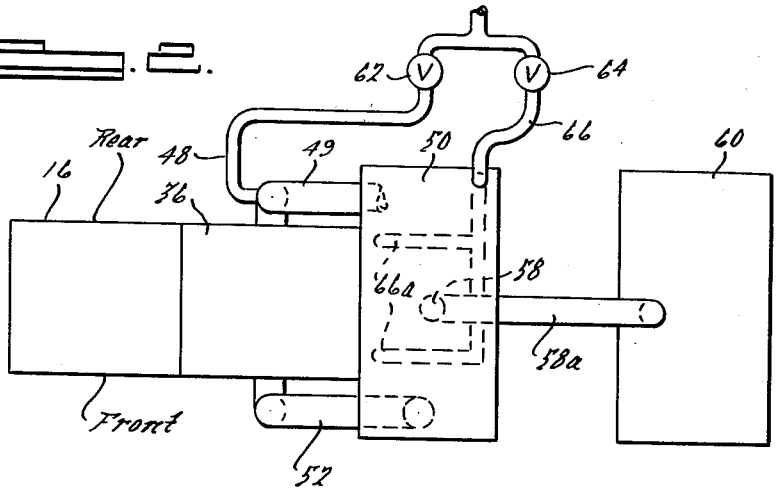
FIGS. 2, 3 and 4 are a schematic plan view, front elevation and rear elevation, respectively, of a preferred separating tank-waste settling tank recirculation arrangement according to the invention.
Figure 3:
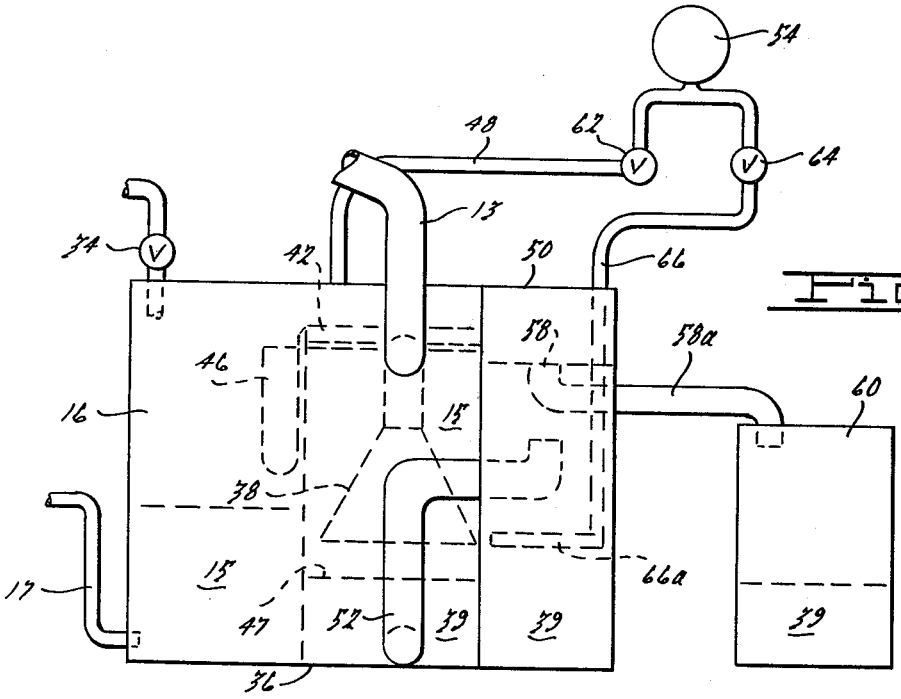
Figure 4:
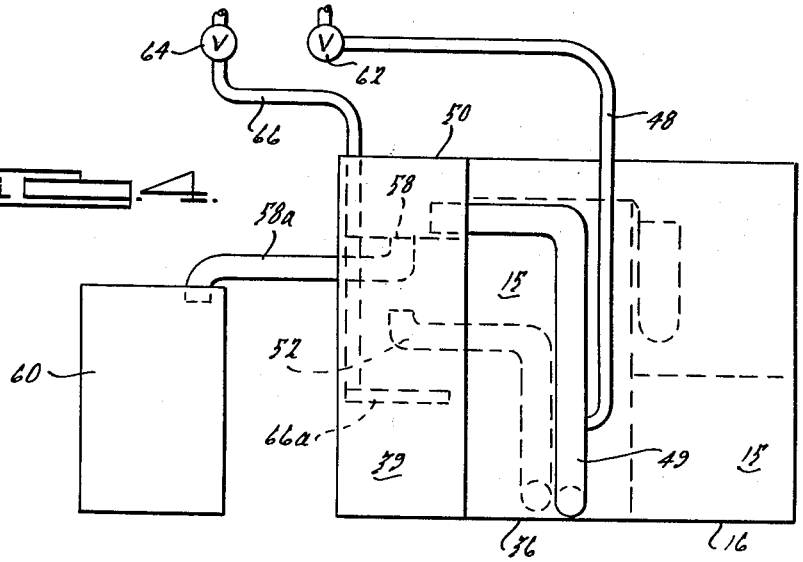

FIGS. 2, 3 and 4 represent a preferred tank arrangement and waste circulating arrangement for preventing the potential buildup of heavy or light fractions of waste in separating tank 36 and in tank 50. FIG. 3 is a front elevation of the plan view of FIG. 2. FIG. 4 is a rear elevation of the plan view of FIG. 2. As can be seen in these figures, air lift pump means formed by air line 48 transfers the waste from the bottom of tank 36, breaks it into small particles and transfers it into waste tank 50 in which the light particles tend to float to the surface and the heavy particles tend to sink to the bottom. The heavier waste liquid is returned to separation tank 36. As more waste is introduced into separating tank 36 through line 13, the level in waste settling tank 50 rises until the waste overflows weir 58 into tank 60 via line **58*a*. Conduits 49 and 52 are positioned opposite each other in both separating tank 36 and in waste settling tank 50. In tank 36, the inlet and outlet means of these conduits are in a lower portion of the tank. In tank 50 the outlet of conduit 49 is in an upper portion of the tank and the inlet of conduit 52 is at a lower level than the outlet of conduit 49. With such an arrangement it is felt that the flow of waste across tank 36 from conduit 52 to conduit 49 tends to more effectively sweep waste into conduit 49 preventing isolated buildup or "dead spots" anywhere in tank 36. The same holds true for the placement of the conduits in tank 50 in which additionally, the flow patterns are such that the heavier fractions of waste tend to sink and settle in tank 50. Intermediate fractions are collected into conduit 52 for recirculation to tank 36 while lighter fractions of waste tend to float and are collected by weir 58 which leads to overflow conduit 58*a* and to tank 60.**

The heaviest fractions of waste tend to accumulate in tank 50 but it is so gradual that only infrequent pumpout is needed.

The arrangement of the aerator lines **66*a*, transverse to the flow path across tank 50,** is believed to provide a turbulence in the tank which further prevents dead spots in the flow across the tank.

The basic principal used by the systems of this invention as illustrated by the above described embodiments remains the same as that described in the aforementioned patented system. That is, the systems operate due to the difference in specific gravity of the flush fluid (0.83 for mineral oil for example) from that of sewage wastes (1.01) which are made up primarily of water.

Figure 5:
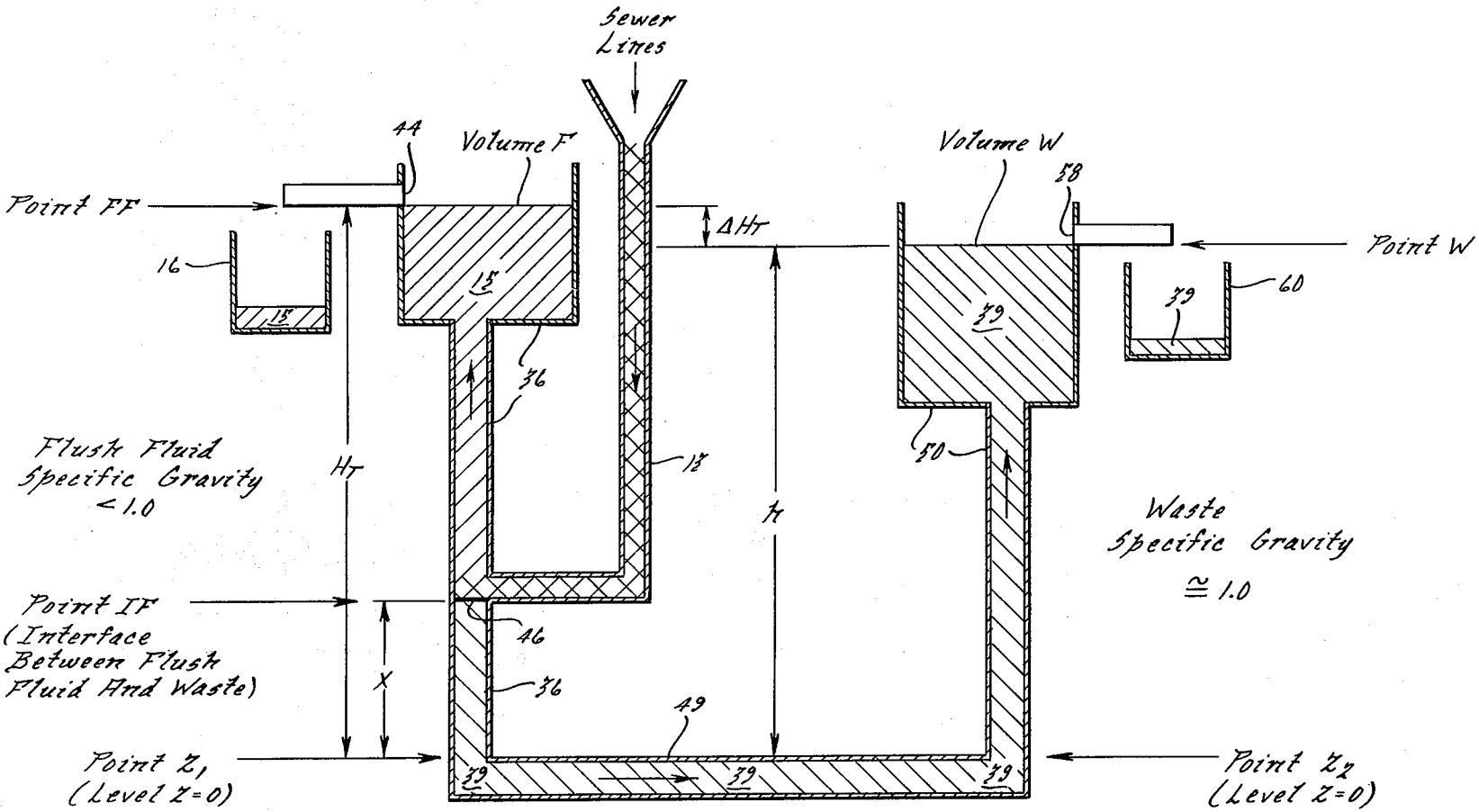
FIG. 5 is a schematic representation of the basic components of a system according to the invention.

FIG. 5 demonstrates this phenomena as it is adapted to a general system according to this invention. In FIG. 5, the pressure at points $Z_1$ and $Z_2$, characterized herein as being arbitrarily at an elevation or level $Z = 0$, must be equal in a static fluid system. The pressure at point W and point FF is atmospheric. If the distance or height between level $Z = 0$ and point W is represented by $h$ then the pressure at level Z will equal $h$ inches of water. Since water weighs 62.32 pounds per cubic foot, then the pressure created by a water column 1 ft high is 62.32 lb/ft$^3$/144 in$^2$/ft$^2$ = 0.433 lb/in$^2$/foot or 0.433/12 = 0.036 psi/inch water. Mineral oil (the preferred flush fluid medium) exerts a pressure of (.036) (.83) = 0.030 psi/inch. Pressure at the Z level is then (0.036 psi/inch) ($h$) or (X) (0.036) + ($H_T$–X) (0.030). With $h$ and $H_T$ defined, X or point IF can be determined for the system or with $H_T$ and point IF or X defined, a desired height $h$ may be determined for the system.

For example, if it is desired to have a separation tank 36 wherein $H_T = 40$ inches and it is desired that the interface stand at 10 inches above the Z level, the solution is:

$$(H_T - X)\,(.030) + (X)\,(.036) = (h)\,(.036)$$

$$h = \frac{(H_T - X)\,(.030) - X\,(.036)}{.036}$$

$$H_T = 40$$

$$x = 10$$

$$h = \frac{(40 - 10)\,(.030) + (10)\,(.036)}{.036}$$

$$h = \frac{(30)\,(.030) + .36}{.036} = 35 \text{ inches}$$

Therefore, $H_T$ would be equal to a 5 inch difference between the level at which the flush fluid would stand and the level at which the waste would stand in the system.

In operation, if the system shown in FIG. 5 were first filled with waste until it overflowed at point W the pressure at Z would be ($h$) (.036) psi. For example, if $h = 35$ inches then the pressure at Z would be (35) (.036) = 1.26 psi. There would be no overflow at Point FF because the waste would be standing $\Delta H_T$ inches below the drain at point FF.

If mineral oil (flush fluid) is slowly added to volume F until it overflows at point FF the system will reach a second equilibrium with waste overflowing at point W and mineral oil overflowing at point FF. Then if the flow of mineral oil stops point IF (the interface) will be defined. The pressure at points $Z_1$ and $Z_2$ will still be equal to ($h$) (.036) psi since the distance and material in the waste side is unchanged. Now, however, the distance $H_T$ is greater than $h$ although pressure at $Z_1$ and $Z_2$ must still be equal.

The pressure exerted by a column of mineral oil flush medium is the specific gravity of mineral oil (0.83) times (0.036) psi/inch for water or (0.83) (0.036) = 0.030 psi inch.

If a mixture of mineral oil flush fluid and waste is introduced to this system through the sewer line, overflow will occur at both point FF and point W since there is a finite volume in the system and the system is already full. Because of the rapid separation of waste and flush fluid the sewage waste will settle into the bottom and cause the overflow of sewage waste at point W; the mineral oil will rise to the top and cause an overflow of mineral oil flush fluid medium at point FF. This happens because point IF remains the interface point between the two dissimilar materials with no substantial change in height or position.

In actual practice the dynamics of flow of new material into the system and the recirculation of the waste into tank 50 will cause additional slight pressures which will be reflected in each leg of the system. This changing dynamic pressure head will cause a fluctuation of Point IF over a narrow range of a few inches. This fluctuation is accommodated by making X large enough so that point IF never reaches point $Z_1$.

This arrangement allows for the continuous introduction of waste and flush fluid into the system and a continuous overflow of the flush fluid and waste into different and separate tanks or the like while guarding against carryover of either with the other following separation.

Since suitable components, such as switches, valves, pumps and the like will be apparent to those familiar with this art, there is no need to describe them in detail. Furthermore, the means for ultimate or final disposal of the separated waste may take the form of any various means such as thermal reduction by incinerators or the like, biological treatment by aerobic digestors or the like, bulk storage in holding tanks or any other suitable means.

In general, any flush fluid medium selected for use with the system according to this invention will be substantially immiscible with water and of a sufficient difference in density or specific gravity from that of water to permit physical separation of the sewage from the flush medium by the settling process. The flush medium will also be chemically stable at the operating conditions of the sewage disposal apparatus and in the presence of human waste and other sewage wastes. Further characteristics of the medium are that it have flow characteristics suitable for flushing and transporting sewage, that it not produce a toxic or fire hazard, and that it be esthetically acceptable in appearance and odor.

Some fluids which have proven to be acceptable are the Dow Corning "DC 200" fluids, Shell Oil Company's "Diala Ax" transformer oil, Monsanto Chemical Company's "MCS 997" or "996", Marathon Oil Company "Sontex 60T," Exxon "Marcol 52," Magic Bros. "Magisol", and ordinary mineral oil. Ordinary mineral oil is a preferred fluid and has been found to be particularly satisfactory, especially the more refined types thereof. "Marcol 52" is a petroleum base oil. The "MCS 997" is an adipate ester. The "DC 200" fluids represent silicone fluids of the dimethyl siloxane polymer type. Pertinent physical characteristics of the fluids are shown in the Table.

TABLE

| Fluid | Specific Gravity | Flash Point | Viscosity |
|---|---|---|---|
| "DIALA Ax" | 0.865 | 300° F | 10 CS at 77° F |
| "DC20010CS" | 0.934 | 325° F | 10 CS at 77° F |
| "DC20020CS" | 0.949 | 450° F | 20 CS at 77° F |
| "DC20050CS" | 0.960 | 545° F | 50 CS at 77° F |
| "MCS 996" | 0.922 | 385° F | 8.22 CS at 100° F |
| "MCS 997" | 0.914 | 450° F | 14.5 CS at 100° F |

Having described the invention, the embodiments thereof in which an exclusive property or right is claimed are defined as follows:

1. A sewage system for separating sewage waste from a flush medium so the medium can be reused, comprising:

a non-aqueous liquid flush medium for receiving and transporting sewage waste, the flush medium having a specific gravity less than that of water, a separating tank for receiving sewage waste being transported by the flush medium, the flush medium separating from the waste upon entering the separating tank and floating on the waste due to its different specific gravity whereby an upper flush medium containing section and a lower waste containing section are established in the separating tank with an intermediate interface, flush medium outlet means positioned in the upper section of the separating tank for allowing flush medium to flow from the separating tank when it reaches the level of the flush medium outlet means thereby controlling the volume of the flush medium retained in the separating tank, a first waste receiving tank connected to the lower waste containing section of the separating tank for allowing waste to flow therefrom into the first waste receiving tank, waste outlet means positioned in the first waste receiving tank for allowing waste to flow from the first waste receiving tank when the waste reaches the level of the waste outlet means thereby controlling the volume of the waste retained in the first waste receiving tank and in the separating tank, whereby the retained volumes are held substantially constant in both tanks due to the two outlet means and whereby the interface in the separating tank remains at a substantially constant level below the flush medium outlet means thereof even with the periodic receipt of additional flush medium and sewage waste by the separating tank.

2. The system according to claim 1 including a second waste receiving tank for receiving waste from the first waste receiving tank outlet means.

3. The system according to claim 1 including flush medium receiving means for receiving flush medium from the separating tank outlet means for reuse of the flush medium.

4. The system according to claim 3 wherein the flush medium receiving means includes a reservoir tank for storing the flush medium.

5. The system according to claim 4 including means for supplying flush medium from the flush medium receiving means to a waste receiving station and further including means for transporting the flush medium and any waste to the separating tank.

6. The system according to claim 4 including fluid maintenance recirculating means connected to the flush medium receiving means for circulating flush medium through the maintenance means.

7. The system according to claim 1 wherein the separating tank includes an inlet conduit for the flush medium and sewage waste, the conduit terminating inside the separating tank in a dispersion cone.

8. The system according to claim 3 wherein the separating tank outlet means includes filter means and chlorinating means for treating the flush medium as it flows to the flush medium receiving means.

9. The system according to claim 8 wherein the filter means includes coalescer means through which the flush medium passes in flowing to the flush medium receiving means.

10. The system according to claim 1 including means for circulating waste between the separating tank and the first sewage receiving tank.

11. The system according to claim 10 wherein the circulating means includes first conduit means leading from a low level in the separating tank to a higher level in the first waste receiving tank and pump means for causing the waste to flow therefrom and second conduit means leading from an upper level in the first waste receiving tank to a lower level in the separating tank.

12. The system according to claim 11 wherein the pump means comprises air lift pump means.

13. The system according to claim 1 including air supply means for aerating the waste in the first waste receiving tank.

14. The system according to claim 11 wherein the first conduit means includes inlet means positioned in the separating tank and the second conduit means includes outlet means positioned in the separating tank substantially opposite each other.

15. The system according to claim 14 wherein the inlet and outlet means are positioned in a lower portion of the separating tank.

16. The system according to claim 11 wherein the first conduit means includes outlet means positioned in first waste receiving tank and the second conduit means includes inlet means positioned in the first waste receiving tank substantially opposite to the outlet means.

17. The system according to claim 16 wherein the outlet means is positioned in an upper portion of the first waste receiving tank and the inlet means is positioned at a lower level than the outlet means.

18. The system according to claim 11 wherein air lift pump means is included within the first conduit means.

19. The system according to claim 11 including aerating means in the first waste receiving tank.

20. The system according to claim 19 wherein the aerating means comprises a plurality of aerating conduits positioned transverse to the flow path established by the outlet and inlet means.

* * * * *